US012339079B2

(12) United States Patent
Kittel

(10) Patent No.: US 12,339,079 B2
(45) Date of Patent: Jun. 24, 2025

(54) FIREARM

(71) Applicant: mb-microtec ag, Niederwangen bei Bern (CH)

(72) Inventor: Andreas Kittel, Linz (AT)

(73) Assignee: MB-MICROTEC AG, Niederwangen bei bern (CH)

( * ) Notice: Subject to any disclaimer, the term of this patent is extended or adjusted under 35 U.S.C. 154(b) by 51 days.

(21) Appl. No.: 17/604,831

(22) PCT Filed: Apr. 20, 2020

(86) PCT No.: PCT/AT2020/060158
§ 371 (c)(1),
(2) Date: Oct. 19, 2021

(87) PCT Pub. No.: WO2020/210856
PCT Pub. Date: Oct. 22, 2020

(65) Prior Publication Data

US 2022/0260330 A1 Aug. 18, 2022

(30) Foreign Application Priority Data

| | | |
|---|---|---|
| Apr. 19, 2019 | (AT) | A 60102/2019 |
| Aug. 14, 2019 | (AT) | A 50718/2019 |
| Sep. 3, 2019 | (AT) | A 50772/2019 |
| Oct. 9, 2019 | (AT) | A 50865/2019 |

(51) Int. Cl.
*F41A 17/00* (2006.01)

(52) U.S. Cl.
CPC ..... *F41A 17/00* (2013.01)

(58) Field of Classification Search
CPC ..... F41A 17/00; C09K 11/02
USPC ..... 42/1.01
See application file for complete search history.

(56) References Cited

U.S. PATENT DOCUMENTS

| | | | | |
|---|---|---|---|---|
| 666,405 A | | 1/1901 | Baggett | |
| 4,007,553 A | * | 2/1977 | Clegg | F41A 17/00 42/132 |
| 4,739,569 A | * | 4/1988 | Battle | F41A 17/00 42/70.01 |
| 5,016,378 A | * | 5/1991 | Sain | F41A 17/52 42/1.01 |
| 5,359,800 A | * | 11/1994 | Fisher | F41G 1/345 42/144 |
| 6,250,008 B1 | * | 6/2001 | Silver | F41A 17/44 42/70.11 |
| 6,510,641 B1 | | 1/2003 | Viani | |
| 6,626,674 B2 | * | 9/2003 | Chudwin | F41A 17/44 42/70.01 |

(Continued)

OTHER PUBLICATIONS

Hendrick, Hal W., et al., "Human Factors Issues in Handgun Safety and Forensics," 2008, pp. 51, 70, 136, 140, CRC Press, Boca Raton, FL.

(Continued)

*Primary Examiner* — John Cooper

(57) ABSTRACT

A firearm is proposed, with an optical safety marking (9.1, 9.2, 9.3, 9.4, 9.5, 9.6) provided on the firearm (1) for clearly indicating the safety state of the firearm (1). In order to increase the safety of the firearm (1), it is proposed for the safety marking (9.1, 9.2, 9.3, 9.4, 9.5, 9.6) to be embodied as phosphorescent and/or fluorescent and/or radioluminescent and/or bioluminescent.

10 Claims, 6 Drawing Sheets

(56) References Cited

U.S. PATENT DOCUMENTS

| | | | | |
|---|---|---|---|---|
| 9,068,785 | B2 * | 6/2015 | Ball | F41A 9/53 |
| 9,097,474 | B1 | 8/2015 | Zins et al. | |
| 11,473,869 | B1 * | 10/2022 | Brandt | F41A 35/00 |
| 2005/0024807 | A1 | 2/2005 | Cerovic et al. | |
| 2010/0088944 | A1 | 4/2010 | Callihan | |
| 2012/0297655 | A1 * | 11/2012 | Ball | F41A 9/53<br>42/1.05 |
| 2014/0047748 | A1 * | 2/2014 | Grossman | F41A 17/46<br>42/1.01 |
| 2014/0202056 | A1 * | 7/2014 | Ball | F41A 9/62<br>42/1.02 |
| 2015/0323267 | A1 | 11/2015 | Donnelly | |
| 2016/0320155 | A1 | 11/2016 | Singh | |
| 2017/0153078 | A1 * | 6/2017 | Elftmann, Jr. | F41A 35/06 |
| 2017/0191775 | A1 * | 7/2017 | Bibee | F41A 17/54 |
| 2018/0231350 | A1 * | 8/2018 | Howe | F41G 1/14 |
| 2020/0240731 | A1 * | 7/2020 | Karchon | F41A 19/33 |

OTHER PUBLICATIONS https://www.youtube.com/watch?v=XQZmDABuQml, "Orange Glow Paint for Gun Safety Lever or Gun Sights," Mar. 8, 2011, Glow-On Super Phosphorescent, 4 min 26 sec.

HK Mark 23 Operator's Manual. <https://hkusa.s3.amazonaws.com/20160809160236/Mark-23-Operators-Manual-AUG-9-2016spread.pdf>. Aug. 2016. (Year: 2016).

Gun Review: Walther PK380. <https://www.thetruthaboutguns.com/gun-review-walther-pk380/>. Apr. 27, 2018. (Year: 2018).

Sauer. <https://www.youtube.com/watch?v=jlA_i-KwYBY>. Apr. 26, 2015. (Year: 2015).

* cited by examiner

FIREARM

TECHNICAL FIELD

The invention relates to a firearm with an optically perceptible safety marking provided on the firearm for clearly indicating the safety state of the firearm.

PRIOR ART

To prevent an unintended discharge, firearms are provided with firearm safeties. An extremely wide variety of firearm safeties are known, for example manual safeties for blocking the travel of a trigger, blocking a sear bar, blocking a hammer, blocking a firing pin, etc., or a combination thereof, trigger safeties, grip safeties, safety manual cocking systems or cocking handles or manual cocking systems, decocking levers, and the like.

Unfortunately, a relatively low value is currently placed on the safety in use of firearms. This is rather surprising, especially since it is precisely the firearm safety, regardless of whether it is slid, rotated, pushed, etc.—that ensures safety before and after firing and is therefore the most important technical safety component of a firearm. In this connection regardless of whether it is a trigger safety, a manual cocking system, a cocking handle, etc., a clear indication of the safety state and of the state of the firearm is mandatory for every time a firearm is handled in order to avoid accidents, injuries, etc.

To clearly indicate the safety state of the firearms, they usually have an optical safety marking. Known safety markings are often embodied in the form of a letter of the alphabet, namely as an S and/or F, or as a dot, for example in a white or red color. Safety markings of this kind are understood and recognizable to weapon carriers, who are familiar with handling them.

As an alternative to optical safety markings, electronic indicators of the safety state of a firearm are known (US666405A). Weapon manufacturers and weapon carriers often reject electronic indicators due to susceptibility to errors, high level of maintenance, and dependence on an external electrical energy source such as a battery.

DISCLOSURE OF THE INVENTION

The object of the invention, therefore, is to modify the design of a firearm known from the prior art in such a way that while maintaining the known handling, it becomes even safer. In addition, this modified-design firearm should be highly durable.

The invention attains the stated object in that the safety marking is embodied as phosphorescent and/or fluorescent and/or radioluminescent and/or radioluminescent. By contrast with currently known safety markings on firearms, it is thus possible to optically provide the weapon carrier at all times and independent of external influences with a clear indication of the safety state of his firearm. The safety marking according to the invention thus makes the safety state of the weapon carrier's firearm always visible to him, which also makes the firearm safer to handle. Preferably, the safety marking is phosphorescent in order to permit clear optical perception of it not only in daylight, but also in conditions of reduced visibility.

This is also achieved without complicating handling of the firearm. Though the safety marking is redesigned, the handling of the firearm remains the same. The safety marking therefore differs significantly from known optically perceptible safety markings in terms of its recognizability/visibility, which also makes it possible to also avoid using known expensive and usually error-prone electronic indicators, etc. on the firearm.

This safety marking according to the invention can thus contribute decisively to increasing the safety of firearms, for example in the private sector, the hunting sector, the professional sector, the hobby sector, the sports sector, law enforcement weapons, or in the military sector. The safety marking according to the invention can particularly improve stress management in the handling of firearms and can provide the weapon carrier with the best possible assistance and thus also protection. It is therefore possible to minimize the number of accidents in the handling of firearms.

In general, a safety marking can be embodied as a dot, a square, a rectangle, a ring, a letter, or other characters or symbols, or even a combination thereof. A firearm can, for example, be a gun, a small arm, a handgun, a pneumatic weapon, a pistol, a long gun, a rocket launcher, etc.

In general, it should also be noted that "fluorescent" or "fluorescence" can be understood to mean a light output that is optically perceptible only during an excitation. By contrast, "phosphorescent" or "phosphorescence" can be understood to mean an optically perceptible light output that is present even after an excitation, which is also often referred to as "glow-in-the-dark."

"Radioluminescent" or "radioluminescence" can be understood to mean any luminescence that is excited by means of nuclear radiation and that results in an optically perceptible light output. Also, "bioluminescent" or "bioluminescence" can be understood to mean a light output that is optically perceptible due to a transformation of chemical energy of a biological system.

The safety of the firearm can be further improved if the safety marking has a first phosphorescent and/or fluorescent and/or radioluminescent and/or bioluminescent layer. In addition, a layer can, for example, serve to provide a uniform brightness, which can increase the visibility of the safety marking.

The visibility of the safety marking can be further improved if the first layer contains phosphorescent and/or fluorescent pigments, particularly inorganic pigments, in a binding agent. In addition, the ruggedness of the safety marking can be further improved based on the binding agent. Suitable candidates for the phosphorescent pigments preferably include inorganic pigments from the group of aluminates. Other glow-in-the-dark pigments (phosphorescent pigments) are conceivable. Fluorescent pigments with tritium are also conceivable.

Preferably, the binding agent, which is particularly plastic-based, has an epoxy resin base or acrylic base so as to enable a high resistance, for example to humidity, UV radiation, oils and grease, creams, tanning agent residues, sulfur compounds, perspiration, etc.

If the first layer is formed by curing a low-viscosity and/or filler-free binding agent with pigments mixed into it, then it is possible, among other things, to enable a high concentration of phosphorescent and/or fluorescent pigments in the first layer. The safety marking according to the invention can thus feature a particularly high luminosity.

The risk of corrosion can be reduced if the safety marking has a protective layer that covers the first layer.

If the protective layer is composed of a paint layer or a transparent layer, then this can further contribute to improving the resistance of the safety marking to environmental influences. A clear lacquer is preferable, in particular a clear lacquer or transparent layer serving as a paint layer. In addition, the protective layer can have an alkyd resin base or a polyester base.

Preferably, the safety marking is provided on a second layer—in particular a white one, for example titanium white—on the firearm. This can not only increase the visibility of the safety marking, it can also protect this safety marking and/or the base material of the firearm from corrosion. Preferably, the first layer of the safety marking is provided on the second layer. This second layer can also be a primer on the firearm.

Preferably, the firearm has a recess in which the safety marking is provided in order to be able to protect it, for example, from mechanical abrasion. This increases the durability of the safety marking on the firearm—even with intensive handling of the firearm.

If the recess has a cross-section that is dovetail-shaped or rectangular or triangular or semicircular, then this can facilitate provision of the safety marking. In addition, a dovetail shape can be used to durably fasten the safety marking to the firearm.

It is conceivable for the safety marking to be applied to the firearm in layers. In this case, the binding agent of the first layer preferably has an acrylic base.

Alternatively, it is also conceivable for the safety marking to be fastened to the firearm by means of an adhesive. Preferably, the adhesive has an epoxy resin base. In this case, the binding agent of the first layer preferably has an epoxy resin base. A different plastic base is also conceivable. Preferably, the safety marking is composed of one piece. This means that the one-piece safety marking can be embodied of one layer or multiple layers and can thus also consist of multiple firmly attached parts.

Preferably, the adhesive contains white, for example titanium white, pigments in order to increase the visibility of the safety marking.

The safety of the firearm can also be further increased by means of a safety marking if this safety marking is haptically perceptible. A weapon carrier can be provided with a haptic response if the surface of the protective layer differs in a haptically perceptible way from the adjacent surface of the firearm.

It is also conceivable for the safety marking to be provided with a tritium gas light source in order to thus be embodied as radioluminescent. It is also conceivable that the safety marking has a radioactive substance such as tritium, a tritium compound, and/or a promethium salt, in order to thus embody the safety marking as radioluminescent. Through excitation with this radioactive substance, fluorescent particles or substances can be illuminated to produce the light output.

The safety marking advantageously has a firearm safety, particularly a manual one, with the safety marking. Preferably, this firearm safety has a safety manual cocking system or cocking handle or manual cocking system, a safety lever or a safety wheel, etc. The firearm safety is preferably a mechanical one.

Preferably, the safety marking is provided on a housing, in particular a receiver and/or plate, a housing system, a system, a system case, a grip, a grip handle, a butt or stock, a trigger guard, a bolt, slide, a safety lever, a safety slider, a safety pusher, a decocking lever, a barrel, a bore, and/or on a manual cocking system or cocking handle or manual cocking system.

The firearm can particularly excel in that to clearly indicate the safety state of the firearm, the only safety marking that is optically recognizable is the one that corresponds to the state of the weapon. This is achieved in that the firearm is embodied, in the event of a change in the safety state of the firearm, to optically cover either the safety marking indicating a safety state of the firearm or the one indicating a ready-to-fire state of the firearm.

For example, in the event of a change in the safety state to ready-to-fire, the safety marking of the firearm that indicates a safety state of the firearm is covered.

In the event of a change in the safety state to safety, the safety marking of the firearm that indicates the safety state of the firearm is optically uncovered.

It is therefore always clearly recognizable in a visual way whether the firearm is in the safety state or in the ready-to-fire state.

This covering of the safety marking can take place with the aid of a movable part of the firearm. To this end, the firearm has a movable part and depending on the position thereof, the safety marking is optically covered. For example, this is done in that after a movement of a movable part of the firearm, the safety marking is optically covered. For example, in that when the safety state is changed to ready-to-fire, the safety marking that indicates a safety state of the firearm is covered by the movable part (e.g.: safety lever) or by another part of the firearm (e.g. safety slider or safety manual cocking system).

Thus depending on the position of the movable part, the safety marking whose indicator does not correspond to the state of the firearm is covered. The safety state of the firearm is thus always clear to the weapon carrier. This solution is also comparatively simple to achieve from a design standpoint. Preferably, the movable part belongs to the firearm safety.

Preferably, the movable part is constituted by the safety lever, the decocking lever, the safety slider, the safety pusher or the safety manual cocking system or cocking handle or manual cocking system or the safety wheel, the safety cog, the safety rocker, or the safety selector. The movable part can belong to the firearm safety and can, for example, be a wing, lever, plate, or rotating element thereof with which the firearm safety is actuated. The movement of the part can be a sliding, rotating, pushing, pivoting, etc.

Preferably, the movable part is embodied to actuate the firearm safety. As a result, the state of the firearm can be changed by means of a preferably mechanical actuation of the movable part.

It is also conceivable for the firearm to be embodied, in the event of a change in the safety state of the firearm, to optically cover one safety marking and to optically uncover another safety marking whose indicated state of the firearm differs from the indicated state of the firearm indicated by the first safety marking. It is thus possible, for example, to always provide the weapon carrier with a clear indication of the two safety states of the firearm, namely a safety state of the firearm or a ready-to-fire state. This simplifies the handling of the firearm even further. Preferably, this takes place by moving a movable part, for example, of the firearm safety. Preferably, this can also make it possible for only one safety marking on the firearm to be optically uncovered, in particular the one that indicates the current state of the firearm.

Preferably, the safety marking is provided for the safety state of the firearm.

Preferably, the safety marking is embodied of one piece, which can increase the durability and can also simplify the handling of the safety marking. This one-piece embodiment can be enabled, for example, by means of an injection molding, printing, or lamination process, etc.

Preferably, the safety marking is embodied of one layer. For example, the safety marking can be embodied of one layer by means of an injection molding process.

Preferably, the safety marking is embodied of multiple layers. For example, the safety marking can be embodied by means of a layer-by-layer build-up. Conceivable options for this include contact processes (such as printing processes or lamination processes or with the aid of application tools such as brushes, etc.) or contactless processes (such as spraying processes, etc.) are embodied. A multi-layered structure by means of an injection molding process is, too. Conceivable options for this include multi-component injection molding, reverse injection molding processes, etc.

BRIEF DESCRIPTION OF THE DRAWINGS

The subject of the invention is shown in greater detail by way of example in the figures based on several embodiment variants. In the drawings.

WAY TO IMPLEMENT THE INVENTION

Figure 1:
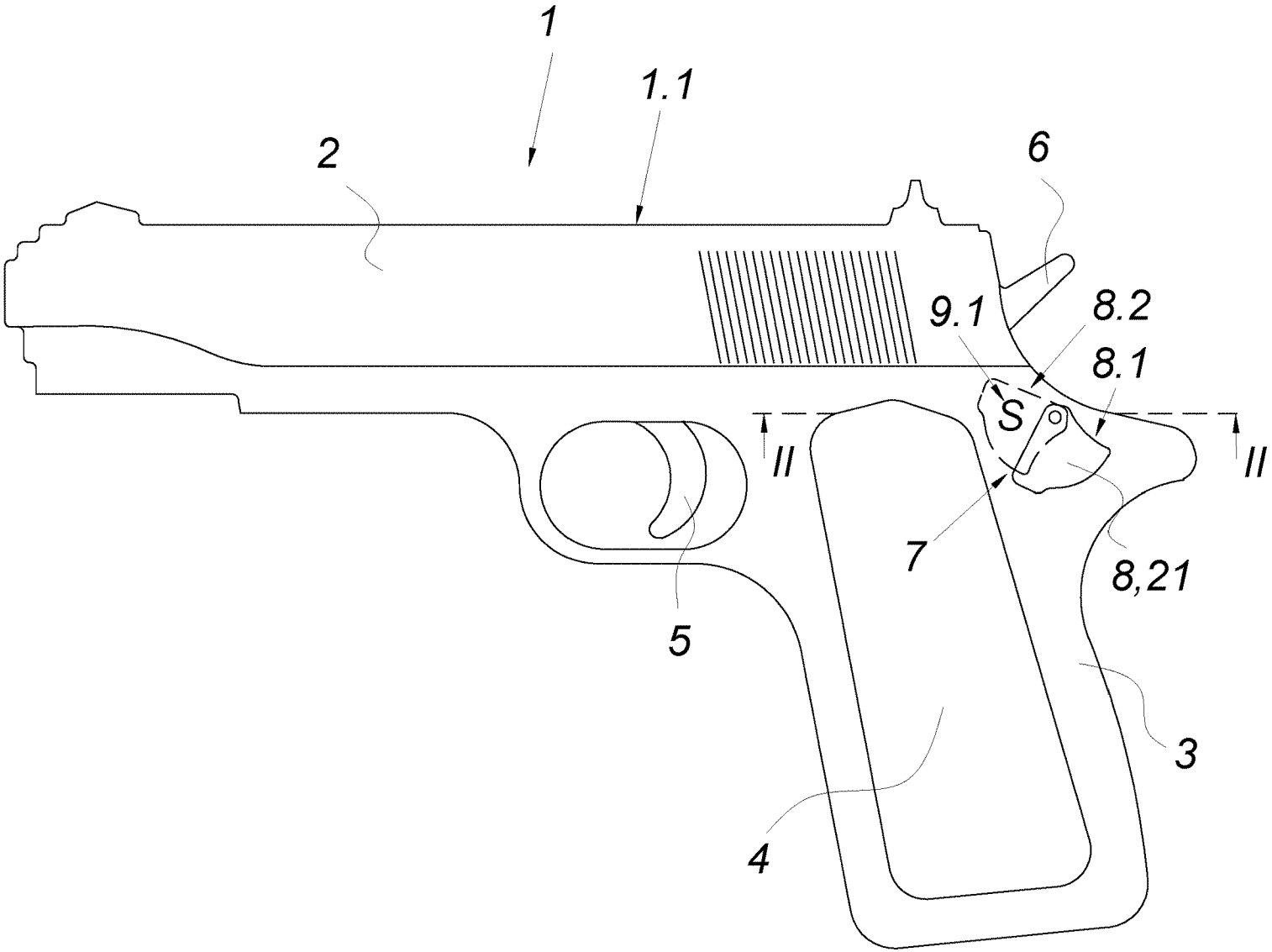
FIG. 1 shows a side view of a firearm according to a first exemplary embodiment.

According to FIG. 1, a firearm 1, namely a pistol 1.1, according to a first exemplary embodiment is shown by way of example. Among other things, this pistol has a slide or bolt 2, a housing 3 with a grip handle 4, a trigger 5, a hammer 6, and a manual firearm safety 7, which is embodied as a mechanical firearm safety 7.

By means of a locking element that is provided on the firearm 1 and is not shown in FIG. 1, this firearm safety 7 prevents a discharge by mechanically blocking the function of the firearm 1. In general, such a manual safety blocks the travel of the trigger. It can act on different parts of the trigger such as the trigger tongue, the sear bar, or the hammer device. Firearm safeties 7 in a wide variety of forms are known from the prior art, for example a grip safety, a decocking mechanism, or a manual firearm safety such as among other things a safety selector, 3-position wing safety, slide safety, cog safety, rocker safety, etc.

By actuating a safety lever 8 of the firearm safety 7, specifically a manual one in this example, the firearm 1 can be switched from a safety state into a ready-to-fire state. For clearly indicating the safety state of the firearm 1, the firearm safety 7 has a safety marking 9.1, namely according to FIG. 1, the alphabetical character or letter S, which shows the weapon carrier that the firearm 1 is mechanically blocked and that a discharge will be mechanically prevented. The firearm 1 is thus in a safety or secured state. To this end, the safety marking 9.1 is visible on the firearm 1 when the safety lever 8 is in the lower position, the safety position 8.1. The safety lever 8 can also alternatively be embodied as a decocking lever 21.

According to the invention, the safety of the firearm 1 is significantly increased by embodying the safety marking 9.1, 9.2 as phosphorescent and/or fluorescent and/or radioluminescent. Due to the for example passive light output (for example in white, green, blue, etc.) of the safety marking 9.1, 9.2, the safety state of the firearm 1 is clear to the weapon carrier and is unmistakably indicated by the light output. The weapon carrier is therefore always clearly aware of the safety state of his firearm 1 and is sure of it. In addition, a weapon carrier is familiar with such a safety marking 9.1, 9.2 so that the handling of the firearm 1 also does not have to be changed in order to increase the safety of the firearm 1. This safety marking 9.1, 9.2 can be embodied as a dot, a square, a rectangle, a ring, a letter or other characters or symbols or also a combination thereof.

Figure 2A:
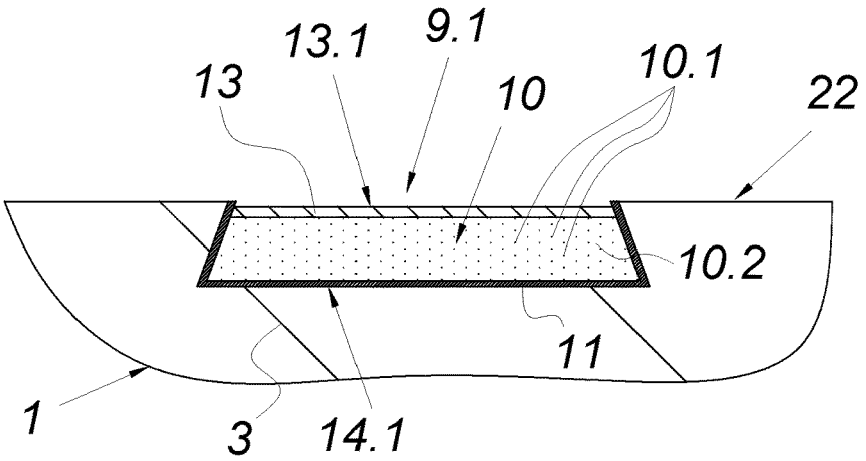
FIG. 2*a* shows a sectional view according to II-II in FIG. 1.

As shown in FIG. 2*a*, the phosphorescent and/or fluorescent and/or radioluminescent and/or bioluminescent property of the safety marking 9.1 that is applied in multiple layers is achieved by means of a first phosphorescent and/or fluorescent and/or radioluminescent or bioluminescent layer 10.

This first layer 10 is formed by curing a low-viscosity and/or filler-free binding agent 10.2 with an epoxy resin base into which phosphorescent and/or fluorescent pigments 10.1 are mixed. As a result, the safety marking 9.1 can have a particularly high luminosity. This ensures a particularly high, for example passive, light emission or light output at the safety marking 9.1 and further increases the safety of the firearm 1. The pigments 10.1 for this preferably phosphorescent layer 10 are, for example, inorganic and are preferably from the group of aluminates or other glow-in-the-dark pigments. For a radioluminescent layer, it is conceivable, for example, to use tritium as a radioactive irradiator of the luminescent particles of the layer.

Another layer is constituted by a titanium white second layer 11 onto which the first layer 10 is directly applied. The second layer 11 that constitutes a primer further improves, among other things, the phosphorescence and/or fluorescence, but also functions as a corrosion protection, particularly for the inorganic pigments 10.1 of the first layer 10.

The first layer 10 is also protected from corrosion and abrasion by a directly applied protective layer 13. A protective paint, in particular a clear lacquer, is used as a protective layer 13. Preferably, the protective layer has an alkyd resin base.

The safety marking 9.1—as can be seen in FIG. 2*a*—is provided in a recess 14.1 on the firearm 1, which particularly protects this safety marking 9.1 from abrasion. Alternatively, a raised area, not shown, can also be provided.

According to FIG. 2*a*, the safety marking 9.1 is applied in multiple layers in the recess 14.1, one layer at a time, for example with an application tool such as a brush, not shown. In this case, the binding agent 10.2 of the first layer 10 of the safety marking 9.1 has an acrylic base. The recess 14.1 has a cross-section that is dovetail-shaped, which results in an undercut that durably holds the safety marking 9.1 in the recess 14.1.

Figure 2B:
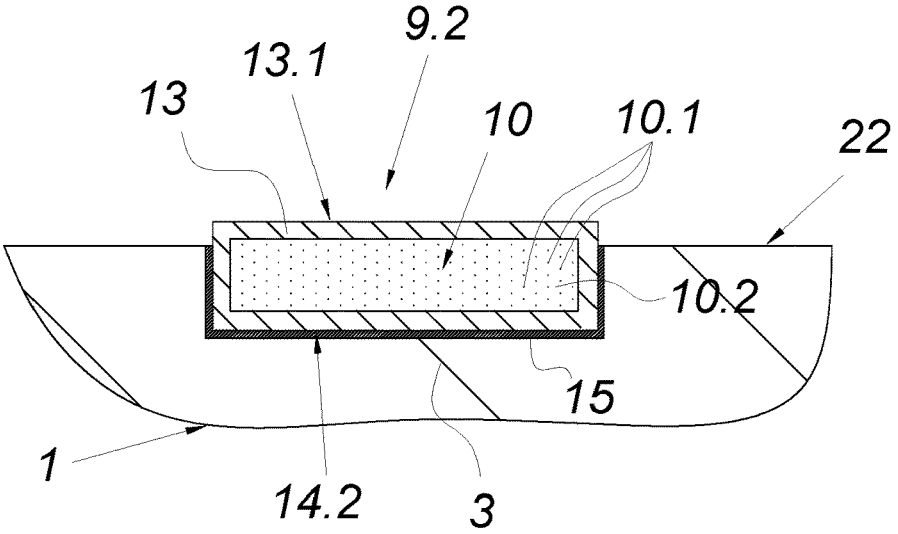
FIG. 2*b* shows a second embodiment of a safety marking alternative to FIG. 2*a*.

FIG. 2*b* shows a safety marking 9.2, which is inserted into a recess 14.2 with a rectangular cross-section and protrudes up from the adjacent surface 22 of the firearm 1. The safety marking 9.2 is fastened to the firearm 1, for example by means of an adhesive 15. But this can also be attached to the firearm in a form-fitting way, which is not shown. This safety marking 9.2 is embodied as multi-layered. By contrast with the safety marking 9.1 from FIG. 2*a*, the first layer 10 of the safety marking 9.2 is encapsulated by the protective layer 13. But it is also conceivable, though, for this safety marking 9.2 to be produced in a single layer by means of an injection molding process, but this is not shown here.

Figure 2C:
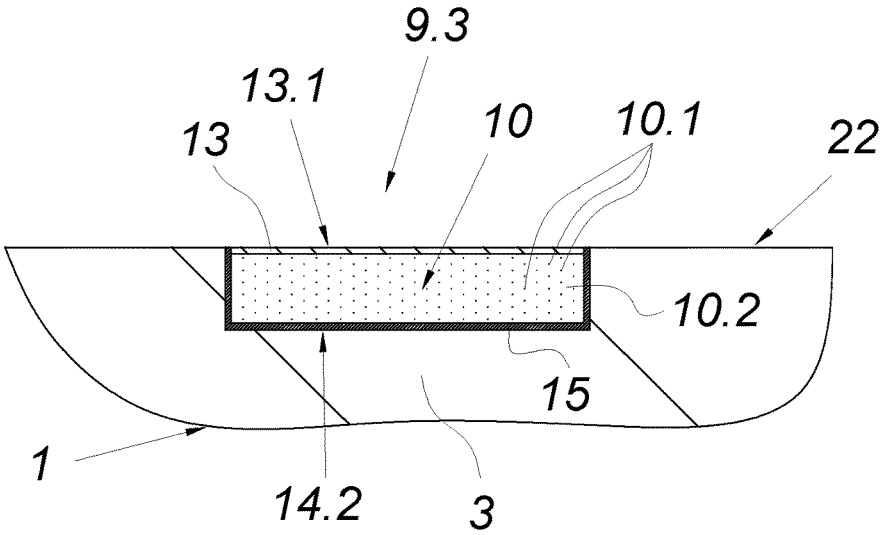
FIG. 2*c* shows a third embodiment of a safety marking alternative to FIG. 2*a*.

According to FIG. 2*c*, a safety marking 9.3 can also be seen, which is fastened in the recess 14.2 with adhesive 15. The adhesive 15 has titanium white pigments and is applied in the form of a primer in the recess 14.2. The adhesive 15 increases the brightness of the safety marking 9.3.

Figure 2D:
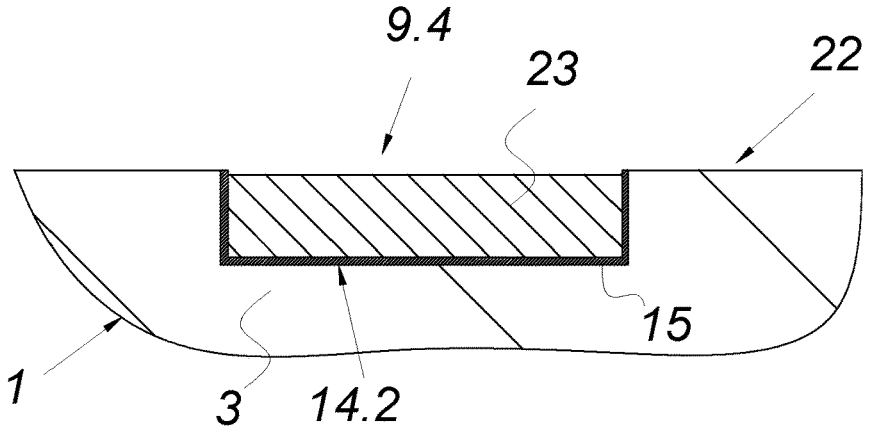
FIG. 2*d* shows a fourth embodiment of a safety marking alternative to FIG. 2*a*.
Figure 2E:
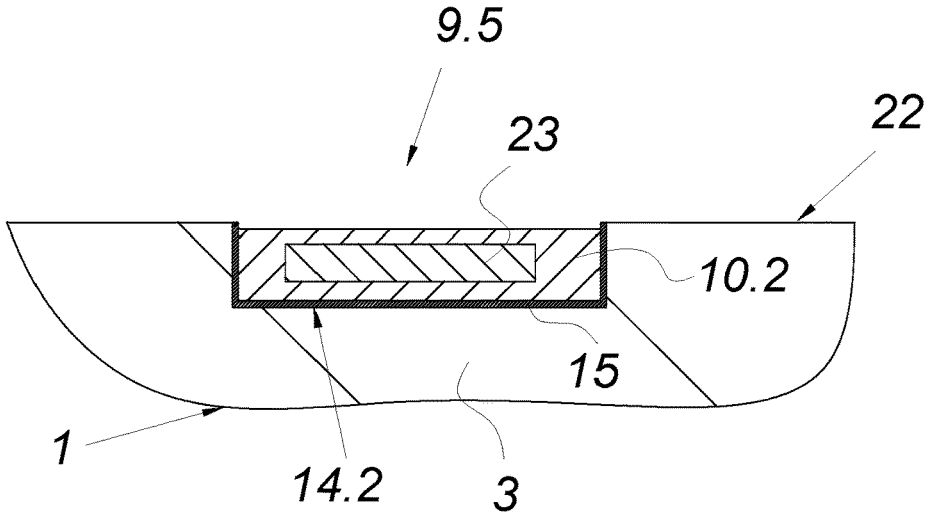
FIG. 2*e* shows a fifth embodiment of a safety marking alternative to FIG. 2*a*.
Figure 2F:
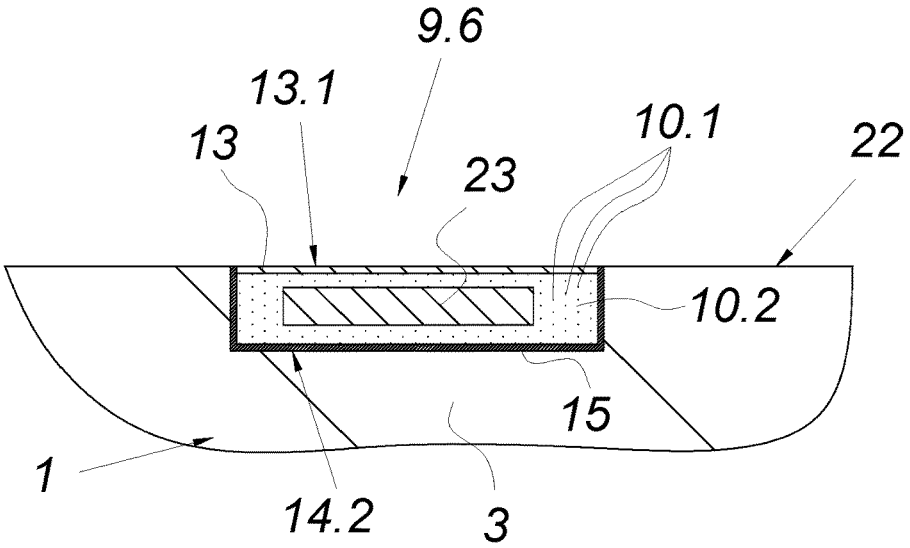
FIG. 2*f* shows a sixth embodiment of a safety marking alternative to FIG. 2*a*.

According to FIGS. 2*d*, 2*e*, & 2*f*, radioluminescent safety markings 9.4, 9.5, 9.6 are shown, which have a tritium gas light source 23. As is known, a tritium gas light source 23 has a glass container, for example composed of borosilicate glass, which container is provided with an illuminant on the inside (for example phosphorus) and is filled with tritium.

According to FIG. 2*d*, a tritium gas light source 23 is shown, which is glued into the recess 14.2. The adhesive 15 has titanium white pigments for this.

According to FIG. 2*e*, the tritium gas light source 23 is provided in a binding agent 10.2, preferably with an epoxy resin base, and is glued into the recess 14.2 with an adhesive 15 in the same way as according to FIG. 2*d*.

According to FIG. 2*f*, the tritium gas light source 23 is provided in a layer 10 that has a binding agent 10.2 and phosphorescent and/or fluorescent pigments 10.1 mixed into it. This layer 10 is also covered by a protective layer 13.

Instead of the tritium gas light source 23, it is also conceivable for a radioactive substance to be added to the binding agent with the phosphorescent and/or fluorescent pigments 10.1. Suitable options for the radioactive substance include, for example, tritium, a tritium compound, and/or a promethium salt. In this case, for example zinc sulfide can be used for the fluorescent pigments 10.1.

By contrast with the safety marking 9.1 according to FIG. 2*a* that is applied in layers, the other safety markings 9.2 to 9.6 are embodied in one piece and are fastened to the firearm 1 by means of an adhesive 15, etc. This one-piece embodiment, for example by means of an injection molding process, can be composed of one layer or multiple layers. A multi-layered structure can, for example, be produced by means of a multi-component injection molding.

The safety marking 9.1 through 9.6 can also be applied to a raised area of the firearm 1, which is not shown here.

In the case of safety markings 9.2 to 9.6 that are fastened to the firearm 1 by means of adhesive 15, the binding agent 10.2 of the first layer 10 has an epoxy resin base.

By means of a protective layer 13, which is recessed in this exemplary embodiment, the safety marking 9.1 is also comparatively easy to perceive, haptically speaking. The surface 13.1 of the protective layer 13 also has a different haptic perceptibility than the adjacent surfaces 22 of the firearm 1, which further amplifies the haptic impression of the safety marking 9.1.

Figure 3:
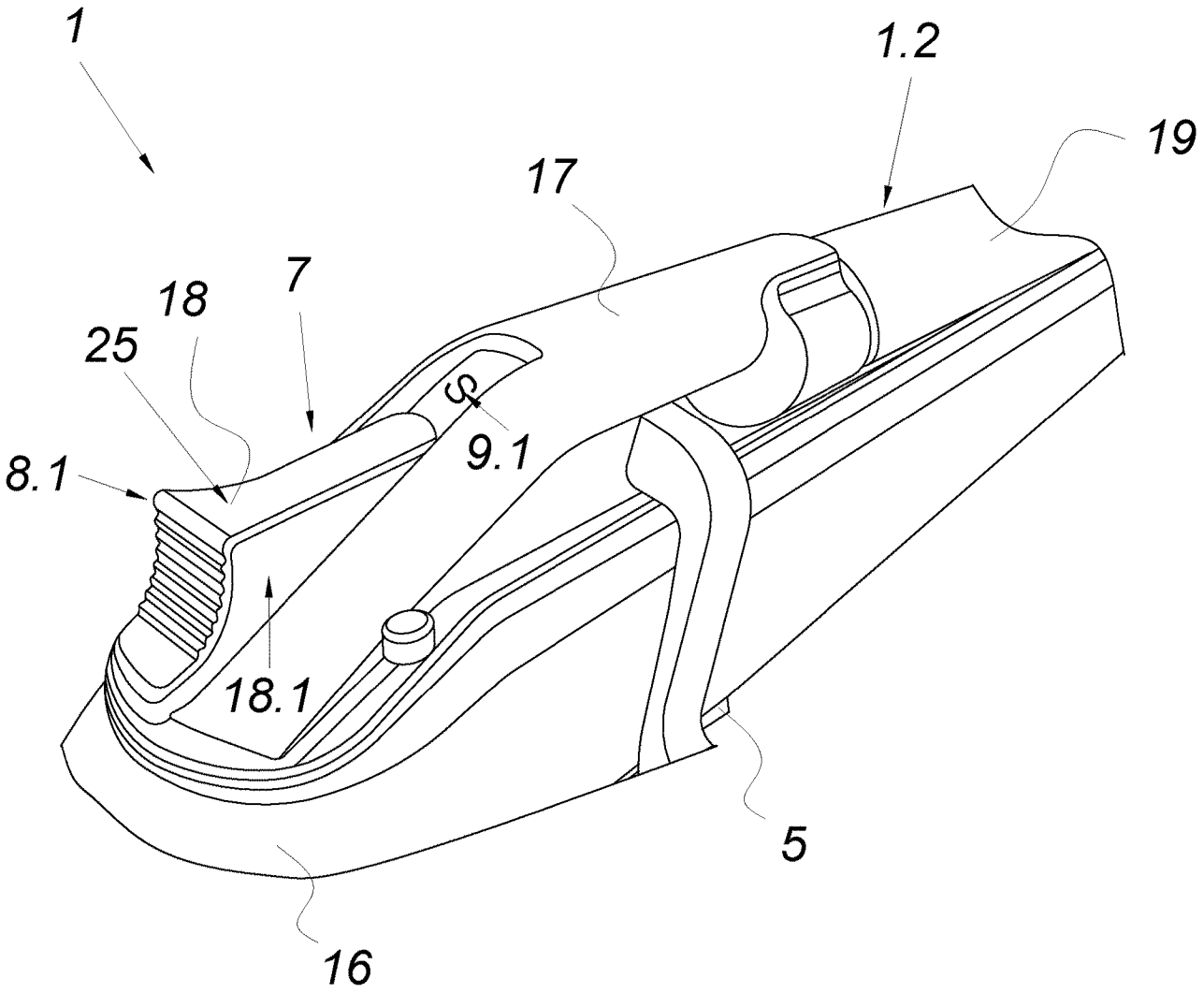
FIG. 3 shows a perspective view of a safety manual cocking system of a firearm according to a second exemplary embodiment.

FIG. 3 shows a firearm 1, namely a long gun 1.2, with a butt or stock 16, according to a second exemplary embodiment. By contrast with the pistol 1.1 according to FIG. 1, this long gun 1.2 has a bolt 17 with a safety manual cocking system 18 or cocking handle or manual cocking system as the firearm safety 7. This safety manual cocking system or cocking handle or manual cocking system 18 is in the lower position, the safety position 18.1. This safety position is distinctly optically perceptible by means of the safety marking 9.1. There is thus a clear indication of the safety state of the firearm 1 or long gun 1.2.

With the cocking of the safety manual cocking system 18 or cocking handle or manual cocking system or with the movement of the safety manual cocking system 18 or cocking handle or manual cocking system in the direction of the barrel 19, the safety marking 9.1, for example in the form of an S, is covered, as a result of which the firearm 1 is cocked and at the same time the safety is deactivated and the firearm is thus ready to fire.

Figure 4:
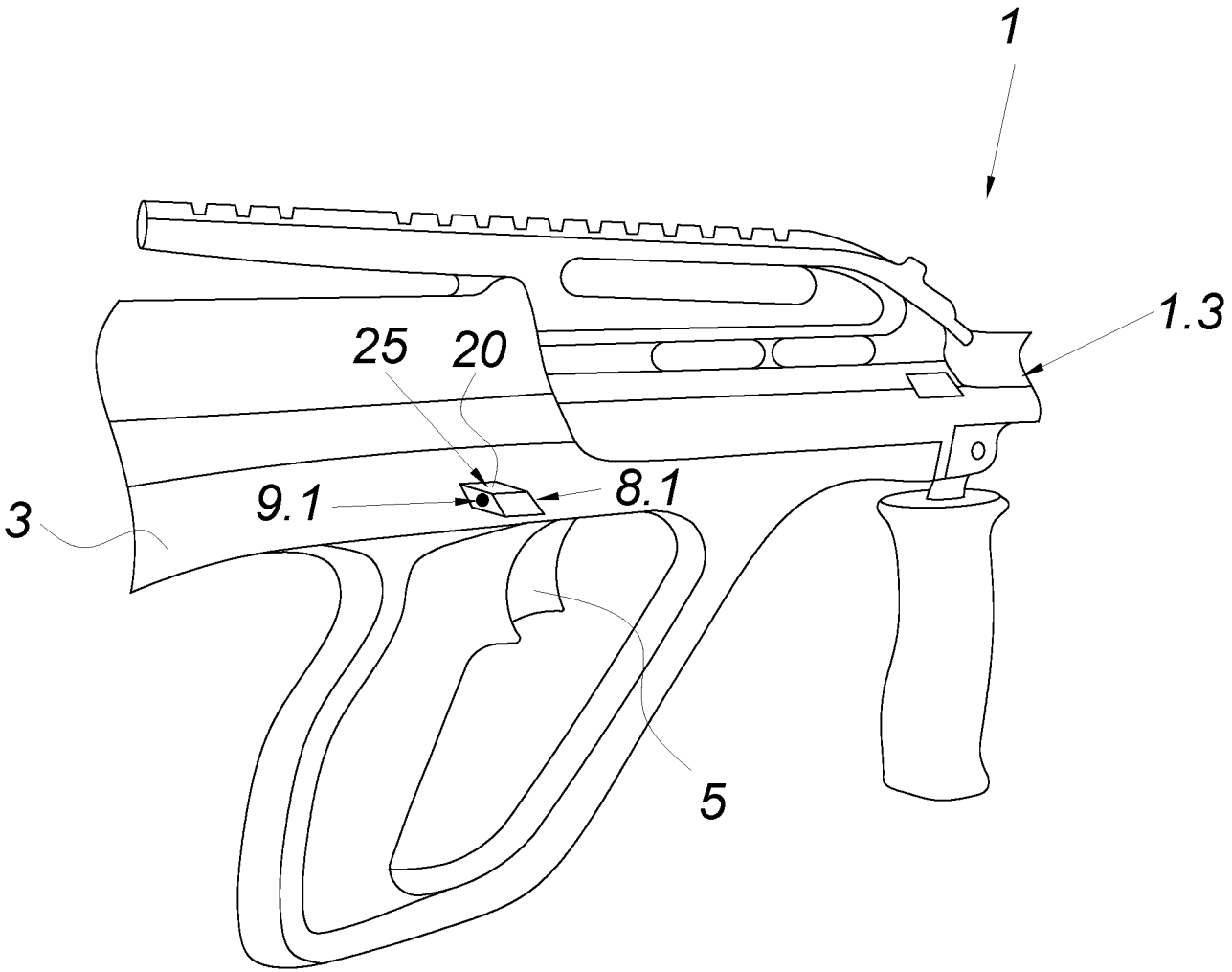
FIG. 4 shows a perspective view of a safety slider of a firearm according to a third exemplary embodiment.

FIG. 4 shows a firearm 1, namely an assault rifle 1.3, according to a third exemplary embodiment. This firearm has a safety slider 20, which mechanically blocks the actuation of the trigger unit 5. On the safety slider, the safety marking according to the invention 9.1 is provided in the form of a dot, for example a white one, which makes the safety state of the firearm 1 clearly recognizable, optically speaking. If the safety slider 20 is moved in order to switch the firearm 1.3 from a safety state into a ready-to-fire state, the firearm 1 or parts thereof such as the housing 3, cover(s) the safety marking 9.1 that indicates the safety state of the weapon. The safety state of the firearm 1 is therefore clear to the weapon carrier. This is because the firearm 1 is embodied, in the event of a change in the safety state of the firearm 1, to optically cover a safety marking 9.1 that indicates a safety state (dot) of the firearm 1, in fact by optically covering the safety marking 9.1 after a movement of the movable part 25, namely of the safety slider 20. The movable part 25 thus belongs to the firearm safety and the movement of the movable part 25, namely the safety slider 20, changes the safety state of the firearm 1.

Other movable parts 25 of the firearm 1 are conceivable for this, for example a safety lever 8 according to FIG. 1, a decocking lever 21 according to FIG. 1, or also a safety manual cocking system 18 or cocking handle or manual cocking system according to FIG. 3 or also a safety wheel, safety cog, safety rocker, safety selector, cog, or rocker, etc. (not shown).

Similarly to the safety slider 20 according to FIG. 4, the safety lever 8 according to FIG. 1 is a movable part 25 that also belongs to the firearm safety, in this case namely the manual firearm safety. The movement of the movable part 25, namely the safety lever 8, changes the safety state of the firearm 1.

It is also conceivable, however, that with a change in the safety state (for example from a safety state into a ready-to-fire state of the firearm), another safety marking 9.7 (e.g. F), which differs from the one safety marking 9.1, 9.2, 9.3, 9.4, 9.5, 9.6 (e.g. S) in the state of the firearm 1, is optically uncovered. This will be explained in greater detail based on FIG. 5*a:*

If the safety lever 8 is now moved from the safety position 8.1 into another position 8.2, namely the firing position 8.2—i.e. upward—, then it covers the safety marking 9.1 for the safety state of the firearm 1. As a result, another safety marking 9.7, for example F, a red dot, etc. for ready-to-fire, is optically uncovered. The different states of the firearm 1 are thus clearly optically recognizable for a weapon carrier. With the clear indication of the safety state of the firearm 1, the latter is therefore particularly easy for the weapon carrier to handle. This is true even independently of the attitude and/or position of the firearm 1.

It is also conceivable, that all of the safety markings 9.1, 9.2, 9.3, 9.4, 9.5, 9.6, 9.7 of the firearm 1 are embodied as phosphorescent and/or fluorescent and/or radioluminescent and/or bioluminescent. As a result, the weapon can be operated in a stress-free way, particularly due to the readability and clarity of the indicator.

To this end, preferably, only the safety marking 9.1, 9.2, 9.3, 9.4, 9.5, 9.6 that indicates the safety state of the weapon or firearm is embodied as phosphorescent and/or fluorescent and/or radioluminescent and/or bioluminescent.

Preferably, the safety marking 9.1, 9.2, 9.3, 9.4, 9.5, 9.6, and 9.7 are part of the manual firearm safety 7.

Figure 5B:
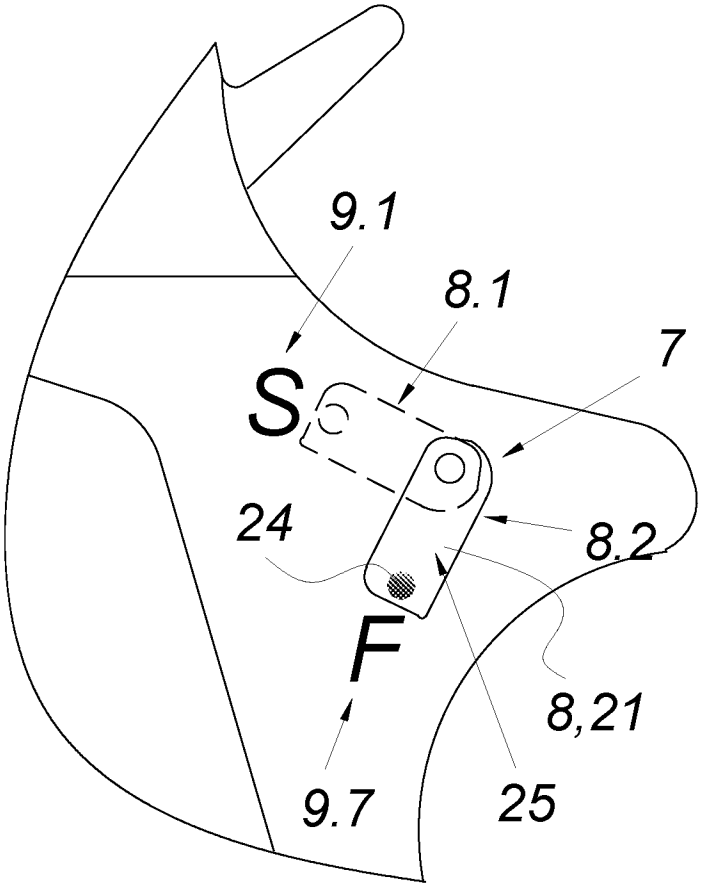
FIGS. 5*a* and 5*b* show detail views of a manual firearm safety.
Figure 5A:
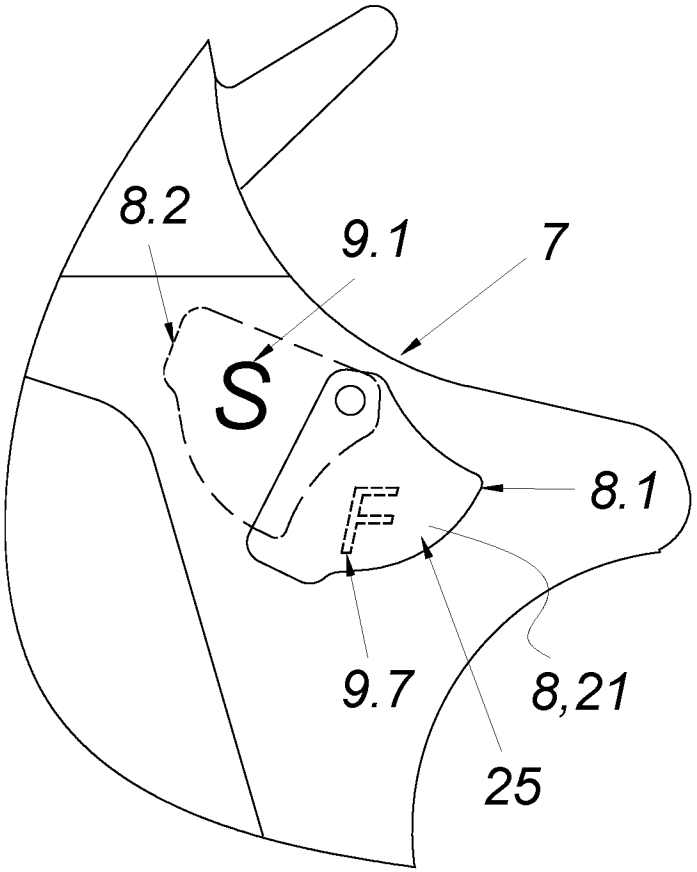

FIG. 5*b* shows another alternative embodiment of a weapon safety 7. In this case, the safety lever 7 has a passive luminescent dot, line, or other position marking 24 etc. so that its position can be identified. Based on the safety marking according to the invention 9.1, 9.2, 9.3, 9.4, 9.5, 9.6, 9.7, observing the safety position 8.1 or firing position 8.2 of the safety lever 7 or of another movable part of the firearm 1 thus makes the state of the firearm 1 clearly recognizable for the weapon carrier. This is also independent of the attitude and/or position of the firearm 1.

The invention claimed is:

1. A firearm comprising:

a firearm safety for clearly indicating a safety state of the firearm by a perceptibility and a non-perceptibility of a light transmission of the firearm safety, the firearm safety having:

a movable part attached to the firearm; and an optically perceptible safety marking provided in a recess on a housing, on a housing system, or on a bolt of the firearm for clearly indicating a safe state of the safety state of the firearm;

wherein the safety marking is radioluminescent and has a tritium gas light source provided in a binding agent, and is fastened to the firearm in the recess by an adhesive; and wherein, depending on a position of the movable part, the safety marking is optically uncovered or covered, such that when the firearm is in the safe state the safety marking is optically uncovered and the light emission of the firearm safety is optically perceptible, and when the firearm is in a ready-to-fire state the safety marking is optically covered and the light emission of the firearm safety is not optically perceptible, such that the safe state of the firearm is unmistakably indicated by the optically perceptible light output of the tritium gas light source.

2. The firearm according to claim 1, wherein the binding agent has phosphorescent pigments and/or fluorescent pigments mixed into the binding agent.

3. The firearm according to claim 2, wherein the safety marking has a protective layer, which covers the binding agent.

4. The firearm according to claim 1, wherein the recess has a cross-section that is dovetail-shaped or rectangular or triangular or semicircular.

5. The firearm according to claim 1, wherein the adhesive has white pigments.

6. The firearm according to claim 1, wherein the firearm has a manual firearm safety with the safety marking.

7. The firearm according to claim 1, wherein at least one of the group consisting of a safety lever, a decocking lever, a safety slider, a safety pusher, a safety wheel, a safety cog, a safety rocker, a safety selector, a safety manual cocking system, a cocking handle, and a manual cocking system constitutes the movable part.

8. The firearm according to claim 1, wherein the movable part is embodied to actuate the firearm safety.

9. The firearm according to claim 1, wherein the safety marking is embodied in one piece.

10. The firearm according to claim 1, wherein the binding agent has an epoxy resin base.

* * * * *